US011413860B2

(12) United States Patent
Wüstner et al.

(10) Patent No.: US 11,413,860 B2
(45) Date of Patent: Aug. 16, 2022

(54) METHOD AND SYSTEM FOR MONITORING A PUMP

(71) Applicant: Canon Production Printing Holding B.V., Venlo (NL)

(72) Inventors: Christoph Wüstner, Poing (DE); Robert Pichlmeier, Kirchheim (DE); Oliver Grossmann, Starnberg (DE); Stefan Misanovic, Munich (DE); Nimitt Bhatt, Eindhoven (NL)

(73) Assignee: Canon Production Printing Holding B.V., Venlo (NL)

( * ) Notice: Subject to any disclaimer, the term of this patent is extended or adjusted under 35 U.S.C. 154(b) by 14 days.

(21) Appl. No.: 17/220,819

(22) Filed: Apr. 1, 2021

(65) Prior Publication Data

US 2021/0309010 A1 Oct. 7, 2021

(30) Foreign Application Priority Data

Apr. 2, 2020 (DE) ..... 102020109222.9

(51) Int. Cl.
*B41J 2/045* (2006.01)
*B41J 2/175* (2006.01)
*F04D 15/02* (2006.01)

(52) U.S. Cl.
CPC ..... *B41J 2/04501* (2013.01); *B41J 2/17596* (2013.01); *F04D 15/0209* (2013.01); *F05D 2270/303* (2013.01)

(58) Field of Classification Search
CPC ..... F04D 15/0088; F04D 15/0272; F04D 15/0209; F04D 15/0263; F04B 51/00; F04B 53/08; F04B 2205/11; F04B 2205/09; F04C 14/28; F04C 15/0096; F04C 2270/80; F04C 2270/19; F04C 2210/205; B41J 2/17596; B41J 2/04501; F05D 2270/303
See application file for complete search history.

(56) References Cited

U.S. PATENT DOCUMENTS 6,803,933 B1 10/2004 Staelin et al.
7,542,875 B2 * 6/2009 Rogers ..... F04B 51/00 417/63

(Continued)

FOREIGN PATENT DOCUMENTS

DE 10156927 A1 6/2003
DE 102004028643 B3 9/2005

(Continued)

OTHER PUBLICATIONS

German action dated May 20, 2020, Application No. 10 2020 109 222.9.

*Primary Examiner* — An H Do
(74) *Attorney, Agent, or Firm* — The Webb Law Firm

(57) ABSTRACT

In a method for monitoring a pump arranged in a flow path to pump a fluid, the temperature of a fluid is regulated by a tempering element during the operation of the pump. The regulation of the temperature may include detecting at least one status point which is formed from an energy supplied to the tempering element and a temperature slope of the tempering element. The status point may be determined in a hazard range by checking whether the status point is located outside of a normal status range, which means that the lifespan of the pump is limited.

18 Claims, 7 Drawing Sheets

(56) References Cited

U.S. PATENT DOCUMENTS

Figure 1:
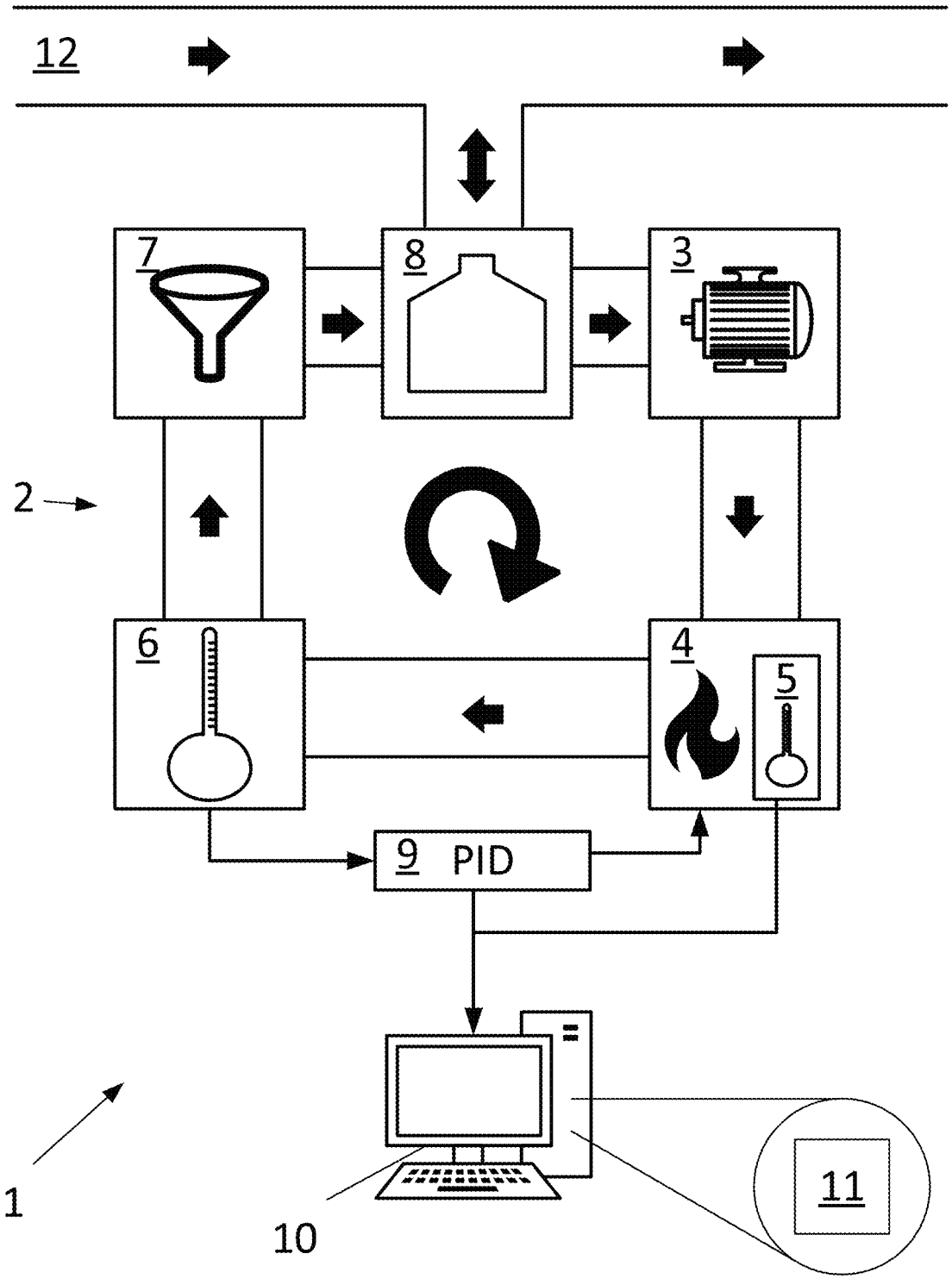

| | | | | |
|---|---|---|---|---|
| 9,091,259 | B2 * | 7/2015 | Tamminen | F04B 23/04 |
| 10,466,135 | B2 * | 11/2019 | Wetherill | F04B 49/06 |
| 10,969,375 | B1 * | 4/2021 | Bayyouk | G01N 33/2888 |
| 2011/0141167 | A1 | 6/2011 | Kikkawa et al. | |
| 2017/0197432 | A1 | 7/2017 | Yamada et al. | |

FOREIGN PATENT DOCUMENTS

| | | | |
|---|---|---|---|
| DE | 69930079 | T2 | 10/2006 |
| DE | 102015119832 | A1 | 5/2017 |
| DE | 102018202027 | B3 | 11/2018 |
| DE | 102017126341 | A1 | 5/2019 |
| JP | 201256136 | A | 3/2012 |

* cited by examiner

METHOD AND SYSTEM FOR MONITORING A PUMP

CROSS REFERENCE TO RELATED APPLICATIONS

This patent application claims priority to German Patent Application No. 10 2020 109 222.9, filed Apr. 2, 2020, which is incorporated herein by reference in its entirety.

BACKGROUND

Field

The present disclosure relates to a method for monitoring a pump.

Related Art

There are a plurality of systems in which a functioning fluid pump is essential. For example, in a printing apparatus, the pump for the ink must function so that the printer may print corresponding ink onto the paper to be printed to.

Especially in large high-capacity printing apparatuses, a failure of the pump, and therefore of the entire printing apparatus, may lead to enormous economic damages. Although the failure of the pump does not inevitably lead to the destruction of the entire printing apparatus, it may be that print jobs are not printed, or are only printed poorly, as of a specific point in time. This non-printing or poor printing may in part only be established in retrospect. An interruption of the printing process is then possibly only with a considerably delay. A considerable waste of paper, also referred to as spoilage, is thus created. The downtime which is due to the repair of the pump also incurs considerable production costs.

For a smooth process, it is therefore important to know the status of the pump in order to minimize such failure times.

Traditionally, a pump is serviced at regular intervals. The status of the pump is then only to be detected during servicing. In the event of doubt, a new pump is installed without the status of the old pump being known at all. This approach leads to frequent downtimes and unnecessary costs due to an unnecessary pump exchange.

Given what are known as predictive maintenance systems (PdM systems), this problem is recognized, and it is sought to calculate the failure probability of the pump in advance via diverse sensor systems. The exchange and the preventative measures may hereby be planned before a failure occurs. A user thus profits from an increased availability during production time.

In "Predictive Maintenance of Pumps Using Conditioning Monitoring", Raimond S. Beebe, 2004, several possibilities are shown as to how the failure of a pump may be predicted in that, for example, the flow rate, pumping rotation speed, and pump capacity are determined. In particular, vibration monitoring and analysis of the pump is hereby addressed, wherein three-axis vibration sensors are placed centrally on the pump. Additionally addressed is the measurement of the system flow resistance, which is to be ascribed to the accumulation of deposits.

Various possibilities for pump monitoring are likewise cited in "Predictive-Maintenance, its application and latest trends", Selcuk, 2017. The most important techniques for pump monitoring are:

contraction monitoring,
lubricant and wear particle analysis, storage and temperature analysis,
capacity monitoring,
ultrasonic noise detection,
ultrasonic flow,
infrared thermography,
visual inspection, and
flow inspection.

In "Fault-Diagnosis Applications: Model-based conditioning monitoring: actuators, drivers, machinery, plants, sensors, and fault-tolerant systems", Isermann, 2011, four models of all stages of the pump cycle were modeled for a membrane pump, depending on the current crank angle. This model includes pressure build-up, pressure stroke, pressure reduction, and finally the intake stroke. The four models require detailed information about the pump, for example the total volume of the hydraulic chamber, the piston area, and the stroke volume, as well as precise fluid properties, for example the modulus of compressibility. In addition, the pressure and the piston velocity of the pump are required. The piston velocity is derived from the electrical current of the electric motor.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1 a fluid circuit with pump and tempering element according to an exemplary embodiment.

Figure 2A:
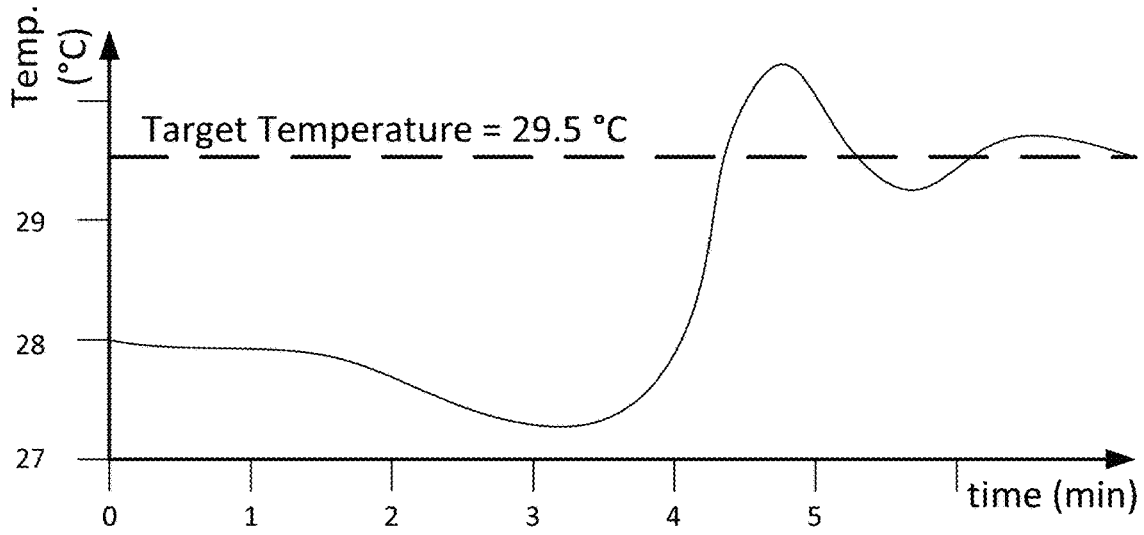

FIG. 2*a* diagram of the time curve of the fluid temperature according to an exemplary embodiment.

Figure 2B:
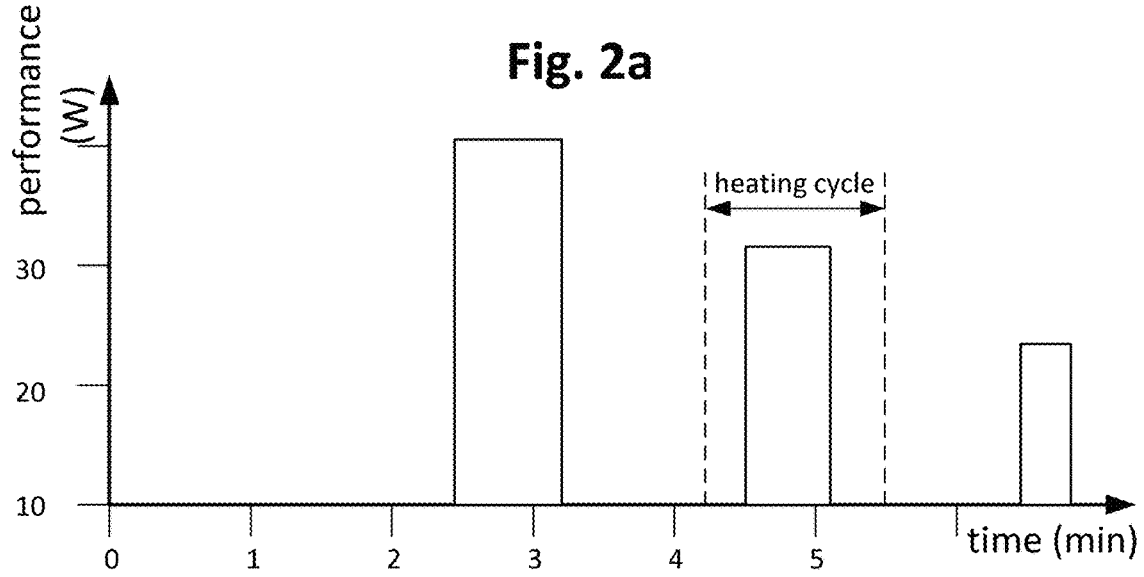

FIG. 2*b* diagram of the performance of the tempering element over time according to an exemplary embodiment.

Figure 2C:
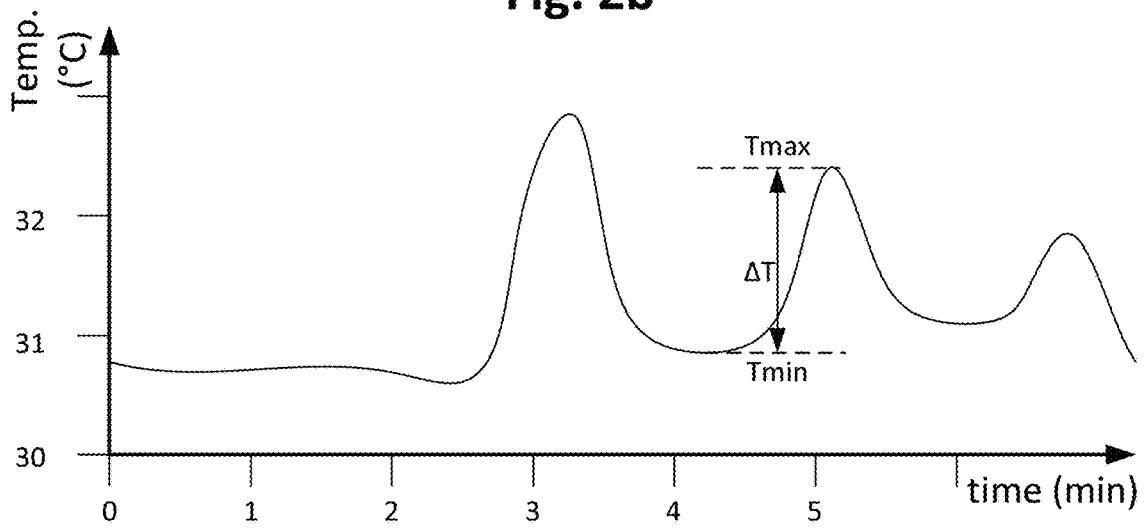

FIG. 2*c* diagram of the time curve of the element temperature according to an exemplary embodiment.

Figure 3:
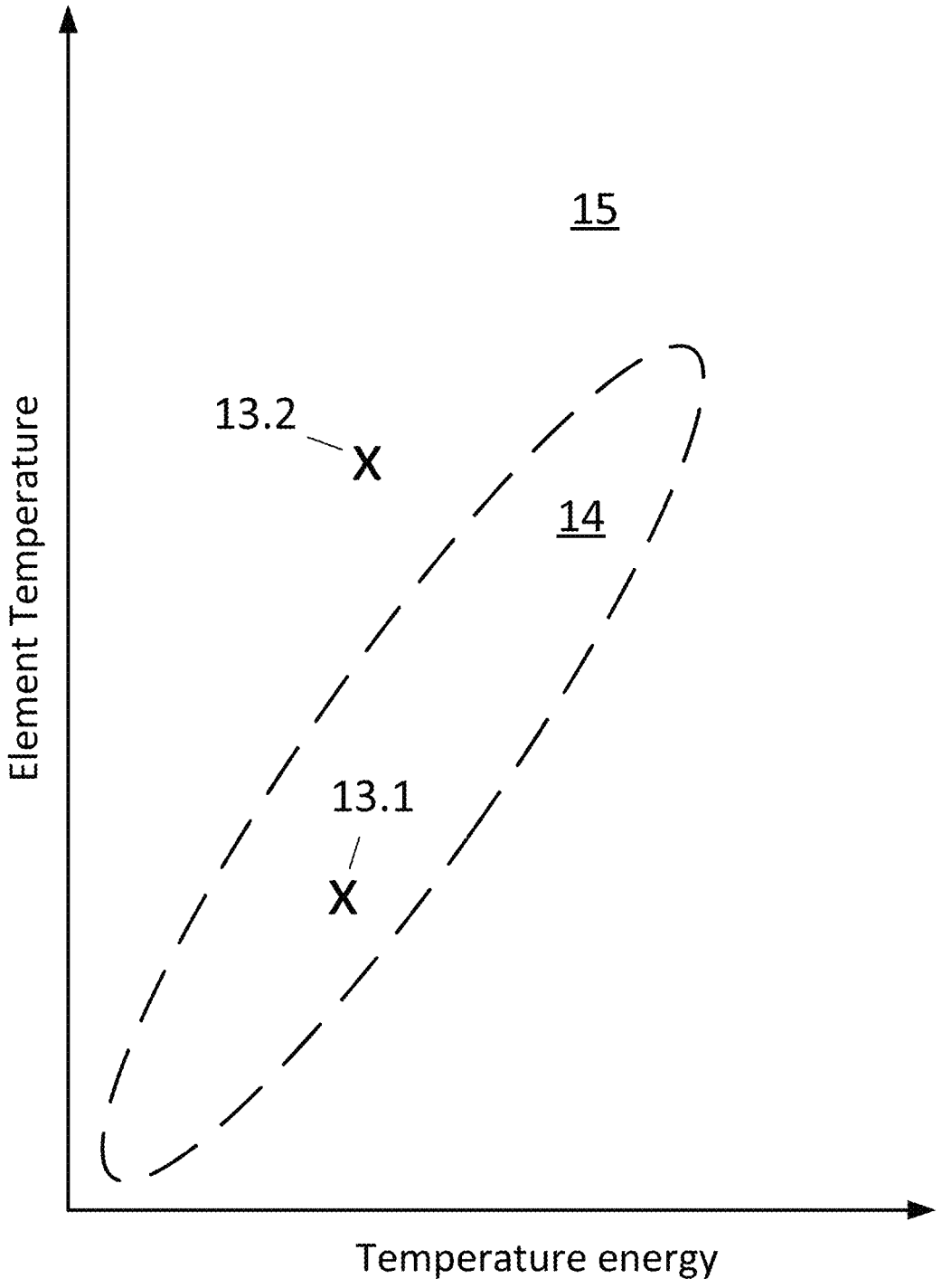

FIG. 3 a diagram of the element temperature and the tempering energy, including the normal status range and hazard range, according to an exemplary embodiment.

Figure 4:
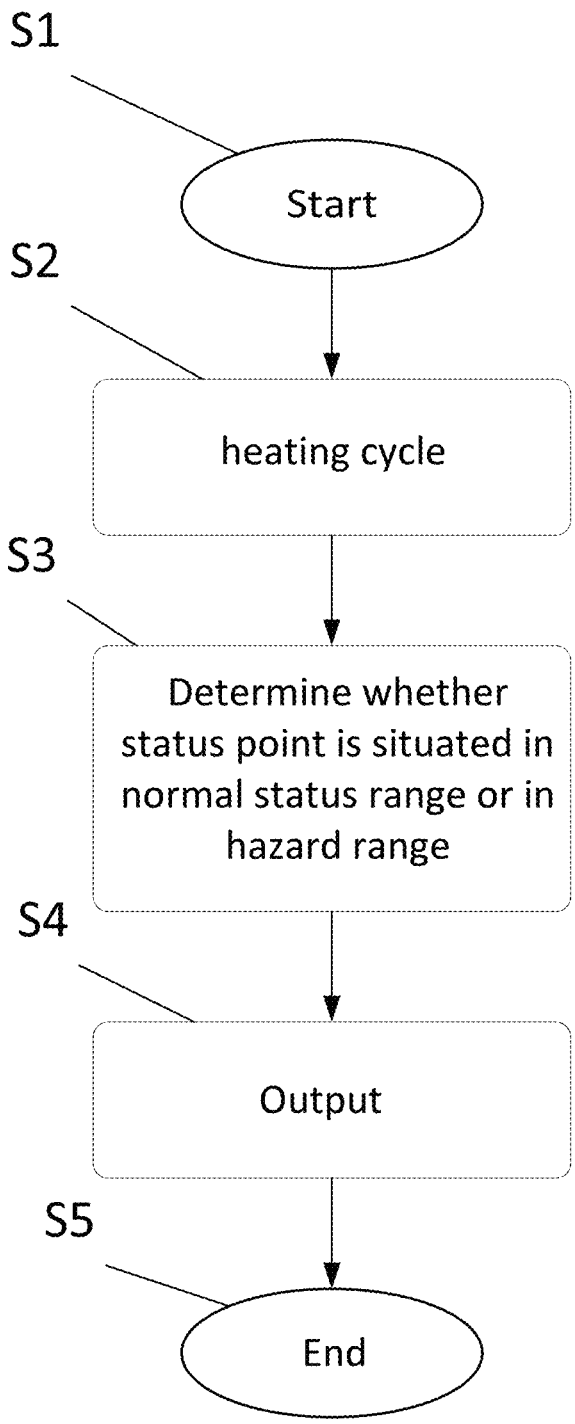

FIG. 4 a flowchart of a method for monitoring a pump according to an exemplary embodiment.

Figure 5:
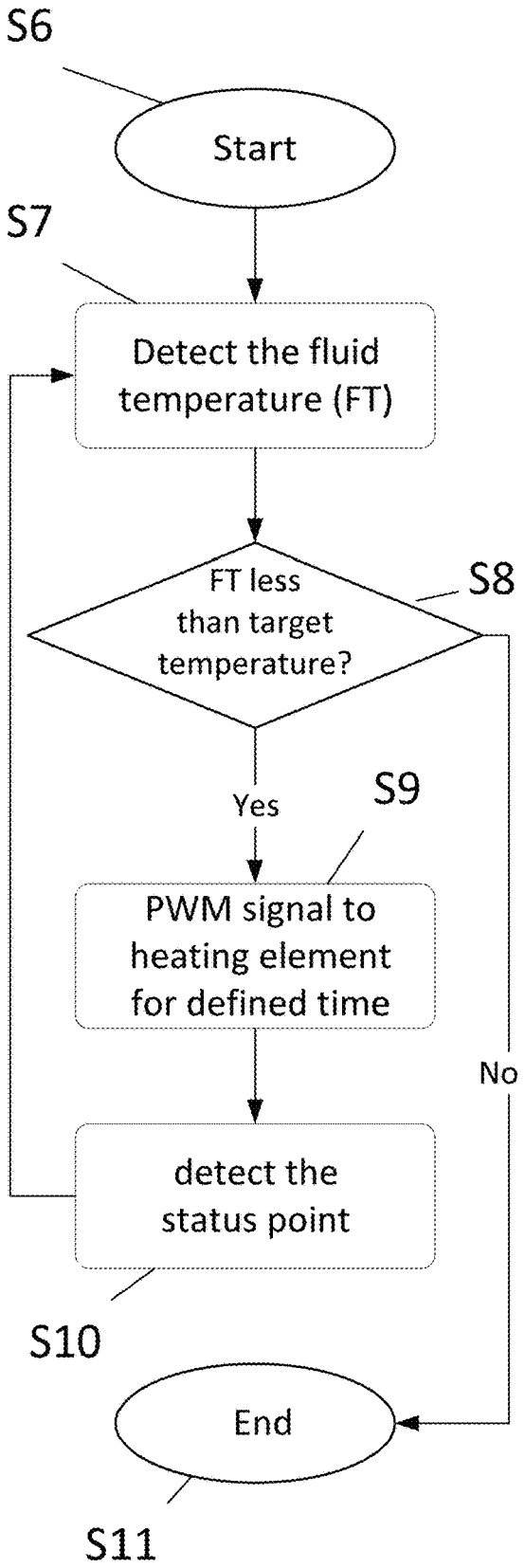

FIG. 5 a flowchart of method of a heating cycle according to an exemplary embodiment.

Figure 6:
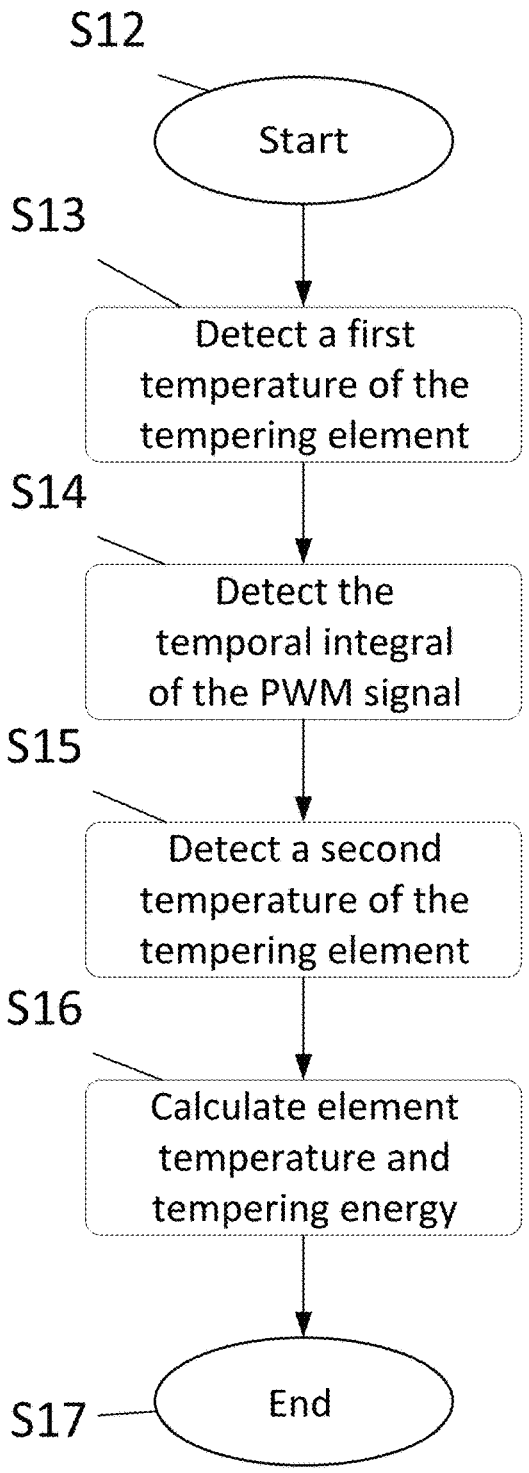

FIG. 6 a flowchart of method for determining a status point according to an exemplary embodiment.

Figure 7:
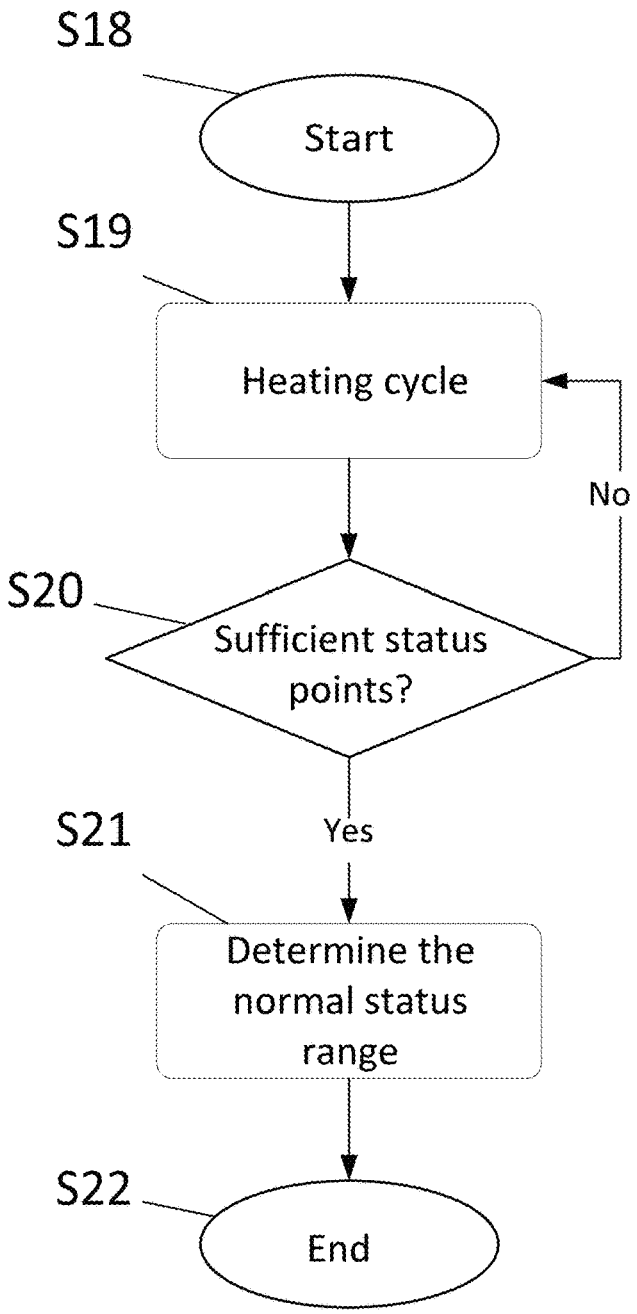

FIG. 7 a flowchart of method for determining the normal status range according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the present disclosure is to provide a method for monitoring a pump with which a malfunction of the pump may be reliably predicted in a simple manner.

Given a method for monitoring a pump which is arranged in a flow path for pumping a fluid, at least one status point is detected, wherein the temperature of a fluid is regulated by a tempering element during the operation of the pump. The status point is formed from an energy supplied to the tempering element, referred to in the following as tempering energy, and a temperature rise of the tempering element, referred to in the following as element temperature. Furthermore, in the method it is determined whether the status point is within a hazard range that is located outside of the normal status range, meaning that the lifespan of the pump is limited.

The status point describes the temperature change of the tempering element after a predetermined tempering process, for example how hot the tempering element was after a heating cycle. Conclusions of the flow velocity of the fluid, and therefore of the status of the pump, may be drawn from the status point.

The tempering energy may also be a pseudo-energy, which may in turn be the temporal integral of a pseudo-power. This pseudo-power may, for example, be determined from the control signal for controlling the tempering element. For example, if the tempering element is controlled with a pulse width modulation (PWM) signal, this PWM signal may be interpreted as a desired pseudo-power of the tempering element. For a defined time period, the pseudo-energy, or also referred to as PWM energy or tempering energy, may be determined from the power supplied here.

The element temperature is measured as a difference of two temperatures. These temperature measurements are chronologically offset such that they detect the temperature change which was caused by the thermal energy. In the simplest case, the temperature is measured, then heating takes place with a corresponding power for a certain time, and the temperature is subsequently measured again. The temporal integral of this power is the tempering energy used here, and the difference of the two temperature measurements is the element temperature.

The status point may be considered as a topological point which is located within a topological space that is spanned at least by the two dimensions of tempering energy and element temperature. A tempering energy and an element temperature are thus associated with each point in this space. The hazard range and the normal status range are respective separate ranges in this topological space.

That the lifespan of the pump is limited means, in the sense of the present application, that the pump will fail in the near future with a certain failure probability. The failure probability may, for example, be ≥60%, preferably ≥80%, and in particular ≥95%. The near future is a defined time period in which pump fails with the corresponding failure probability, and may be less than 30 days, in particular less than 15 days, and preferably less than 3 days, for example.

In contrast to the methods shown in the prior art, in the method described here no additional sensors are needed that check the status of the pump. The necessary measurement values (tempering energy and element temperature) are typically measured in fluid pumps.

The method described above thus derives the status of the pump from the data already available. An implementation of the method is hereby possible even given printing apparatuses that have already been designed and built. If printing apparatuses have a corresponding computing capacity, the method may also be retrofitted even though the printing apparatuses have already been delivered to customers.

Due to the simplicity of the method, a multitude of pump types may be used.

The physical principle on which the method is based is that the efficiency of the pump changes at a certain time before the pump fails. A few days before the pump fails, the pump will pump somewhat less strongly than before. As a result of this, the fluid in the circuit is pumped more slowly through said circuit. Due to the slow pumping, the flow rate of the fluid through the tempering element is reduced. The fluid transports heat or cold away from the tempering element. For example, if the tempering element is a heating element, the fluid cools the tempering element. If the flow rate decreases, the cooling capacity of the fluid also decreases. As a result of this, the tempering element heats more strongly than given a fully functional pump. If the tempering element is a cooling element, the temperature of the tempering element is decreased by the slowed fluid. Regardless of whether it is a heating or cooling element, the status point changes its position due to poorer pump performance.

A failure of the pump may occur due to age-related wear, for example, but also due to a clogged filter. With this method, the failure of the pump may be predicted independently of the cause of the failure.

In an exemplary embodiment, the fluid is tempered in a fluid circuit, wherein the fluid circuit has at least one input and one output.

Via a fluid circuit, the fluid may be tempered to a defined temperature with little effort. The pump in the fluid circuit may thus direct the fluid repeatedly past the tempering element, and thus heat it. In the method described above, a heating cycle may also include multiple passes of the same fluid.

In an exemplary embodiment, the fluid may be a liquid, such as a printer ink.

Liquids are characterized in that they typically are good thermal conductors, whereby they are good at transporting heat or cold away from the tempering element. A temperature change given the same performance is thus easily detectable.

In an exemplary embodiment, a printing apparatus, in particular an ink printing apparatus, includes the pump and the tempering element.

Printing apparatuses, in particular ink printing apparatuses, react very sensitively to the failure of a pump. The printing process is then no longer possible. Therefore, it is advantageous if the failure of the pump in such printing apparatuses may be detected as early as possible.

The tempering element may be a heating element for heating the fluid circuit.

Heating elements may be controlled simply by an electric current, comparable to the cooling elements. The monitoring of the supplied power is hereby simple.

In an exemplary embodiment, the hazard range is associated with a failure probability.

If a status point in this hazard range has been measured, a failure probability may thereby be associated in a defined range, for example greater than 80% in the next 15 days. It is also conceivable that a plurality of hazard ranges are respectively associated with a failure probability or a failure probability range. These multiple hazard ranges may also be superimposed and/or overlap. For example, a larger hazard range might be associated with a failure probability of ≥80% in the next 10 days, and a smaller hazard range within the first hazard range might be associated with a failure probability of 95% in the next 10 days.

The normal status range may be determined in that a plurality of status points are recorded in a learning phase, and the set of status points is mapped to the normal status range.

The learning phase is to be differentiated from a warning phase. The learning phase and warning phase are temporal phases. A method as it is described above is executed in the warning phase.

How the normal status range is formed is learned in the learning phase. Each measured status point is hereby considered to be part of the normal status range.

The learning phase has two sub-phases, a training phase and a validation phase. Both phases may contain mixed data from problem-free pumps and from pump failures. Since time curves are being mapped, data for the validation phase must be recorded chronologically after the training phase. Moreover, the validation phase necessarily needs to include data from defective pumps.

An OC-SVM model is dependent on the training data used and corresponding parameters. The training data are utilized in order to automatically generate OC-SVM models via parameter variation. For this, both the subset of the training data and the model parameters are varied.

In the validation phase (this contains data that the models have not "seen" until now), a few known pump failures are characterized manually (and all other data are characterized as "problem-free"). All existing validation data are subsequently assessed. The model is chosen that has had the best success with these validation data. This is determined via the best possible combination of "positive prediction value" ("precision") and sensitivity (also hit rate) ("recall").

The model which has scored best on the validation data is chosen for the warning phase.

In the learning phase, a predetermined surrounding range may also be associated with each status point, which surrounding range is likewise associated with the normal status range.

The predetermined surrounding range may, for example, be a round range formed with a predetermined radius around the status point. Furthermore, it is possible that additional geometric shapes are chosen, for example a square having a predetermined edge length and the status point as a center point.

Since it is very improbable that exactly the same status point from the learning phase is measured again in the warning phase, status points in the warning phase that are similar to one of the status points from the learning phase should also be considered to be associated with the normal status range.

The range between three respective status points from the learning phase is likewise attributed to the normal status range.

If numerous status points are measured during the learning phase, these form a point cloud. It may be assumed that a status point which is measured in the warning phase and is located within this point cloud is likewise part of the normal status range.

At least three points are necessary in order to determine a two-dimensional area. However, a plurality of points may also be selected. The area of the normal status range is then the outermost boundary of the point cloud of status points measured in the learning phase.

In an exemplary embodiment, the set of status points measured in the learning phase is statistically cleaned.

This means that outliers are looked for via statistical methods, and if applicable these are not taken into account in the assessment of the normal status range. Such outliers of status points may arise due to measurement errors. For example, such a measurement error may arise if the pump is activated and stray currents falsify the measurement of the supplied energy.

The learning phase may be limited chronologically, or by a predetermined number of measurements of status points.

The advantage in chronologically limiting the learning phase is that, in this chronologically limited time period, it may be better guaranteed that the pump is functional. For example, the learning phase may be limited to 360 days, preferably 180 days, and in particular to 90 days.

The advantage of coupling the learning phase to a defined number of measurements of status points is that it is ensured that the set of measured points is sufficient to define the normal status range. For example, if the fluid circuit is operated for one day, then deactivated for 180 days, and then placed in operation again, a chronological limit may possibly be sufficient, but the number of measured status points is not sufficient since effectively only two days have been measured.

However, a combination of both limitations is also possible. A chronological limit of one year may be present, for example, but the learning phase ends earlier if 10,000 status points have been measured before then, for example.

In an exemplary embodiment, a status point which is measured in a predetermined tolerance environment of the normal status range during the warning phase will expand this normal status range.

The tolerance range abuts the edge of the normal status range and has a predetermined thickness. The thickness of the tolerance range may also be dependent on defined factors; for example, the more measured status points in an adjoining region in the normal status range, the narrower the tolerance range.

In this instance, the region is a portion of the normal status range which has been divided in this region in a predetermined manner. The more points that are situated in a defined region, the more that it may be assumed that this region has a clear boundary. By contrast, if a region has only a few status points, the edge of the normal status range in this region may not be defined precisely enough. Therefore, in this region the tolerance range is chosen to be larger.

If, in a warning phase, a status point is measured that is situated in this tolerance range, this status point is associated with the normal range. The tolerance range may thereupon be shifted due to the newly achieved outer boundary. However, care must hereby be taken that a slow drift of the pump which predicts a breakdown is not disguised by continuous expansion of the normal status range.

In an exemplary embodiment, the normal status range is determined by a classification algorithm, in particular by a One-Class Classification algorithm, and preferably by a One-Class Support Vector Machine (OC-SVM) algorithm.

The identification of status points requires an anomaly detection which is enabled via corresponding algorithms.

For example, domain-based or range-based outlier detection algorithms may be probabilistic, distance-based, neighbor-based, or be based on the attempt to isolate outliers.

One-class classification is an alternative to the more traditional multi-class classification, which is characterized in finding a decision boundary that separates two classes. Here a class is a demarcated range in a topological space. By contrast, given a one-class classification algorithm, the goal is to find an optimally large boundary around a positive class or set, and at the same time to minimize the probability that this range contains data of the negative class or set. The positive class or set here corresponds to the normal status range. The negative class or set corresponds to the hazard range. Such a one-class classification algorithm is characterized primarily by the detection of outliers. In the present method, outliers are symptoms that the pump has a limited service life. The outliers are then situated in the hazard range.

A particularly effective method of outlier detection is provided by what is known as the One-Class Support Vector Machine (OC-SVM) algorithm. The algorithm solves a quadratic minimization problem in order to find a separative hyperplane (the normal status range) with maximum clearance between the input data (the status points) and the origin in a higher dimensional space (see Schildkopf et al, "Support Vector Method for Novelty Detection", in: Proceedings of the 12th International Conference on Neutral Information Processing Systems, NIPS'99, Cambridge, USA, 1999, pp. 582-588).

OC-SVMs implicitly learn the range of the most prominent probability density of the status points. A density of a region of interest (abbreviated as ROI) is conventionally calculated empirically in that the number of measurements of the status points in a defined region is considered. By contrast, in the OC-SVM approach it is then sought to find the boundaries around a region that contains the desired number of status points. The advantage of OC-SVMs is their robustness with respect to status points from the learning phase that contain outliers. Furthermore, the OC-SVM also functions well in instances in which the density of the data distribution is not well defined.

The status point and the normal status range may have one or more auxiliary parameters. The auxiliary parameters describe at least one of the following properties:

fluid temperature,
fluid velocity,
fluid density,
fluid pressure,
fluid composition,
ambient temperature,
conduit length, and/or
conduit cross-section.

Each of these auxiliary parameters forms an additional dimension of the space in which the status points, the normal status range, and the hazard range are located. The original two-dimensional problem may hereby be expanded into a multi-dimensional problem. For example, it is thus conceivable that a status point is located in the normal status range given a defined tempering energy, element temperature, and fluid pressure, while a status point with the same tempering energy, the same element temperature, and a different fluid pressure is already located in the hazard range.

One or more hazard ranges may be more precisely defined via the addition of a plurality of auxiliary parameters. The accuracy of the prediction of a failure probability thereby increases.

In an exemplary embodiment, at least two status points are detected at a predetermined time interval from one another. The time change of the status points may be taken into account in checking whether the status is situated in a normal status range.

Rapid changes of the currently measured status point in one and/or other dimensions may indicate whether the pump will fail soon or not. For example, if the element temperature changes by only a maximum of 0.5° C. given a consistent tempering energy, and then jumps to a change of 2° C., this may indicate a breakdown of the pump even though the last measurement is still within the normal status range.

In an exemplary embodiment, a printing apparatus, such as an ink printing apparatus, includes a pump and an ink management module for executing the method described above for monitoring the pump.

In the following, the method for monitoring a pump is explained using a printing apparatus 1 having a fluid circuit 2 for heating a fluid (FIG. 1). In this exemplary embodiment, the fluid is ink.

In an exemplary embodiment, the fluid circuit 2 has a pump 3 for pumping; a tempering element 4 configured to heat the ink, having an element temperature sensor 5 which determines the temperature of the tempering element 4; a fluid temperature sensor 6 configured to measure the temperature of the ink; a filter 7 configured to filter the ink; and a buffer tank 8 to buffer the ink.

The elements of the fluid circuit 2 are connected with one another via pipes or hoses. An element may also include a further element. For example, the pump 3 may also include the filter 7.

A PID (proportional-integral-derivative) controller 9 is connected via data lines with the fluid temperature sensor 6 and the tempering element 4. The PID controller is configured to regulate the temperature of the ink (e.g. based on data from the sensor 6). In an exemplary embodiment, the PID controller 9 includes processor circuitry that is configured to perform one or more functions and/or operations of the PID controller 9.

An evaluation system (evaluator) 10 is connected via data lines with the PID controller 9 and the element temperature sensor 5, and comprises an ink management module 11 with which a failure probability of the pump 3 can be determined. In an exemplary embodiment, the evaluation system (evaluator) 10 is a computer that includes the ink management module 11. In an exemplary embodiment, the evaluation system 10 includes processor circuitry that is configured to perform one or more functions and/or operations of the evaluation system 10.

The buffer tank 8 is connected to a printer conduit 12, so that the warmed ink may be conducted further to a print head and new ink arrives in the buffer tank 8.

The method for monitoring a pump 3 is explained in the following (FIG. 4). The time period in which the pump 3 is monitored is referred to in the following as a warning phase.

The method begins with step S1.

In the next step (S2), the ink is heated to a defined target temperature in a heating cycle. A portion of the method of the heating cycle is the detection of a status point 13. The status point 13 includes at least one tempering energy and an element temperature. The method is described in more detail further below.

It is subsequently determined whether the status point 13 is situated in the normal status range 14 or in a hazard range 15.

The normal status range 14 and the hazard range 15 are ranges in an energy-temperature diagram (see FIG. 3). The normal status range 14 has a closed edge. Each range that is not located in the normal status range 14 belongs to the hazard range 15. If the status point 14.1 is situated in the normal status range 14, no failure of the pump 3 is to be expected. By contrast, the status point 13.2 is situated in the hazard range 15; the lifespan of the pump 3 is thus limited. In the present instance, this means that a failure of the pump 3 in the next one to two weeks is to be expected with 95% probability. In other exemplary embodiments, other failure probabilities and time periods are also possible.

Step S4 follows, in which the result is output of whether the status point 13 is situated in the normal status range 14 or in the hazard range 15. For example, this may be executed via a warning lamp at the printing apparatus 1, or via a notification at a computer of a user.

The method ends with step S5.

The method of how a heating cycle is implemented (FIG. 5) is explained in the following.

The method begins with Step S6.

In the next step (S7), a fluid temperature is detected by the fluid temperature sensor 6.

In Step S8, a check is subsequently performed as to whether the fluid temperature is less than a target temperature (FIG. 2*a*).

If the fluid temperature is less than the target temperature, a pulse width modulation signal (PWM signal) is sent from the PID controller 9 to the tempering element 4 for a predetermined amount of time (Step S9). The tempering element 4 hereby heats the ink (FIGS. 2*a* and 2*b*).

A PWM signal is characterized in that switching takes place only between two states ("ON" and "OFF"). This may be switched repeatedly within a predetermined amount of time. If a low heating performance should be provided, the integral of the signals that are associated with the "OFF" command is greater than the integral of the signals which are associated with "ON". Via a pulse width modulation, arbitrary values can be generated in the temporal integral even though the original signal has only two states. The tempering element 4 may thus heat the ink with a defined energy dose.

Step S10 follows, in which a status point 13 is detected. This is described in detail further below.

After the detection of the status point 13, the fluid temperature is detected again (Step S7), and a check is made as to whether the fluid temperature is less than the target temperature (Step S8).

If it has been established that the fluid temperature is higher than or equal to the target temperature, the method ends with Step S11.

The method for detecting a status point 13 is explained in the following (FIG. 6).

The method begins with Step S12.

In the next step (S13), a first temperature Tmin of the tempering element, here tempering element 4, is detected (FIG. 2*c*).

The temporal integral of the PWM signal is subsequently detected (Step S14). The temporal integral of the PWM signal corresponds to the tempering energy (See FIG. 2*b*).

Step S4 follows, in which a second temperature of the tempering element Tmax is detected (FIG. 2*c*). This second temperature is only detected if a PWM signal no longer reaches the tempering element 4. If applicable, a wait time may be waited so that the second temperature is the maximum temperature to which the tempering element 4 has been heated by the PWM signal.

In an alternative embodiment, a plurality of temperatures may also be detected, and only the maximum temperature is detected as a second temperature of the tempering element 4.

In the following step (S16), the element temperature and the tempering energy are calculated. As already mentioned, the tempering energy is proportional to the temporal integral of the PWM signal. The element temperature $\Delta T$ is the difference of the first temperature of the tempering element Tmin and the second temperature of the tempering element Tmax: $\Delta T = Tmax - Tmin$.

The element temperature and the tempering energy together yield the status point 13.

The method ends with step S17.

The method for determining the normal status range 14 (FIG. 7) is explained in the following. The method is implemented in a learning phase. The learning phase is a time period, and differs from a warning phase in that no failure probability is determined; rather, it is sought to determine a normal status range 14.

The method begins with step S18.

In the next step (S19), a heating cycle is implemented (see FIG. 5 and specification above).

A check is subsequently performed as to whether sufficient status points 13 have been detected (Step S20). For example, this may be the case if a defined number of status points 13 have been detected, or a defined time period has elapsed. If sufficient status points 13 have not been detected, additional status points 13 are detected in an additional heating cycle (Step S19).

If the number of status points 13 is sufficient, the normal status range 14 is determined in step S21. The status points 13 detected in the learning phase may first be cleaned of outliers. The remaining status points 13 in their entirety form the normal status range 14. Furthermore, a surrounding range with a predetermined radius is placed around every single status point 13. All points in this surrounding range also belong to the normal status range 14. All points are additionally connected to one another via a nearest-neighbor network, wherein the outermost line of this network represents the edge of the normal status range 14. At least three status points 13 are hereby necessary.

The normal status range 14 may easily be determined as what is known as a hyperplane, particularly via what is known as a one-class classification algorithm, in particular via a one-class support vector machine algorithm, wherein the status points 13 recorded in the learning phase correspond to the training data of the algorithm.

An additional possibility is that additional conclusions may be drawn using the position of the measured status point 13 within the normal status range 14. For example, this may mean that, if a trend is to be recognized that the status points 13 increasingly move in the direction of the edge of the normal status range 14, the measurement frequency increases.

An additional possibility is that the hazard region 15 is subdivided into different hazard range regions. A different failure probability in a defined time period is associated with each of these hazard range regions. A lower failure probability is thus associated with a hazard region that is very close to the normal status range 14 than a hazard region that is further distant.

In an alternative embodiment, the normal status range 14 may be a fixed, predetermined range which is limited via mathematical functions. These mathematical functions may be fixed for each printing apparatus type. For example, such a mathematical function may be:

$$T_limit = X \cdot 5(^\circ\ C./W),$$

where ° C./W indicates the slope, and X is the measured tempering performance. If the measured element temperature is greater than T_limit, the status point 13 is situated in the hazard range 15. Additional, more complicated functions are naturally also conceivable.

An additional possibility is that the measured status points 13 in the warning phase are likewise considered as status points 13 in the learning phase in order to be able to more precisely define the normal status range 14. This is reasonable in particular when the status points 13 measured in the warning phase are located in the normal status range 14 and/or in a tolerance range that adjoins the border range of the normal status range 14. A year may pass before a pump 3 fails. In this time, numerous status points 13 are measured, wherein an actually occurring failure may then be more easily detected.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein. In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 printing apparatus
2 fluid circuit
3 pump
4 tempering element
5 element temperature sensor
6 fluid temperature sensor
7 filter
8 buffer tank
9 proportional-integral-derivative (PID) controller
10 evaluation system
11 ink management mod
12 printer conduit
13 status point
14 normal status range
15 hazard range

The invention claimed is:

1. A method for monitoring a pump arranged in a flow path and configured to pump a fluid, a temperature of the fluid being regulated by a tempering element during operation of the pump, the method comprising:

detecting at least one status point formed from a tempering energy supplied to the tempering element and an element temperature corresponding to a temperature slope of the tempering element; and determining whether the at least one status point is situated in a hazard range located outside of a normal status range, wherein the at least one status point being situated in the hazard range is indicative of a lifespan of the pump being limited.

2. The method according to claim 1, wherein the fluid is tempered in a fluid circuit having at least one input and one output.

3. The method according to claim 2, wherein the tempering element is a heating element configured to heat the fluid circuit.

4. The method according to claim 1, wherein the fluid is a liquid printer ink.

5. The method according to claim 1, wherein an ink printing apparatus includes the pump and the tempering element.

6. The method according to claim 1, wherein the hazard range is associated with a failure probability.

7. The method according to claim 1, wherein the normal status range is determined in that a plurality of status points are detected in a learning phase, and a set of the plurality of status points maps to the normal status range.

8. The method according to claim 7, wherein a predetermined surrounding range is associated with each status point in the learning phase, the predetermined surrounding range being likewise associated with the normal status range.

9. The method according to claim 7, wherein a range between three respective status points is associated with the normal status range in the learning phase.

10. The method according to claim 7, wherein the set of the plurality of status points measured in the learning phase is statistically cleaned.

11. The method according to claim 7, wherein the learning phase is limited chronologically and/or by a predetermined number of measurements of status points.

12. The method according to claim 1, wherein the normal status range is expanded in response to a status point being measured in a predetermined tolerance environment of the normal status range during a warning phase.

13. The method according to claim 1, wherein the normal status range is determined via a classification algorithm.

14. The method according to claim 13, wherein the classification algorithm is a one-class support vector machine (OC-SVM) algorithm.

15. The method according to claim 1, wherein the status point and the normal status range have one or more auxiliary parameters describing at least one of the following properties:

fluid temperature,
fluid velocity,
fluid density,
fluid pressure,
fluid composition,
ambient temperature,
conduit length, and/or
conduit cross-section.

16. The method according to claim 1, wherein at least two status points are detected at a predetermined time interval from one another, a time change of the status points being taken into account in the check as to whether the status point is situated in a normal status range.

17. A non-transitory computer-readable storage medium with an executable program stored thereon, that when executed, instructs a processor to perform the method of claim 1.

18. An ink printing apparatus, comprising:

a pump arranged in a flow path and configured to pump ink; and a processor configured to regulate a temperature of the ink using a tempering element during operation of the pump, wherein regulation of the temperature includes:

detecting at least one status point formed from a tempering energy supplied to the tempering element and an element temperature corresponding to a temperature slope of the tempering element; and determining whether the at least one status point is situated in a hazard range located outside of a normal status range, wherein the at least one status point being situated in the hazard range is indicative of a lifespan of the pump being limited.

* * * * *